United States Patent [19]

Vogt et al.

[11] 3,930,805

[45] Jan. 6, 1976

[54] APPARATUS RECEIVING CATALYSTS FOR THE DECONTAMINATION OF EXHAUST GAS OF INTERNAL COMBUSTION ENGINES

[75] Inventors: Wilhelm Vogt; Eitel Goedicke; Gerhard Mietens, all of Hurth-Efferen; Hermann Glaser, Erftstadt Lechenich, all of Germany

[73] Assignee: Hoechst Aktiengesellschaft, Frankfurt am Main, Germany

[22] Filed: Aug. 27, 1973

[21] Appl. No.: 392,055

[52] U.S. Cl. ..... 23/288 F; 23/288 FB

[51] Int. Cl.[2] ..... B01J 8/02; F01N 3/15

[58] Field of Search ..... 23/288 F, 288 R, 288 FB; 210/350, 351, 352; 55/475

[56] References Cited

UNITED STATES PATENTS

| | | | |
|---|---|---|---|
| 2,253,516 | 8/1941 | Haldeman | 210/351 X |
| 3,001,605 | 9/1961 | Hill | 55/475 X |
| 3,018,841 | 1/1962 | Gerlich | 23/288 F X |
| 3,094,394 | 6/1963 | Innes et al. | 23/288 F |
| 3,441,382 | 4/1969 | Keith et al. | 23/288 F |
| 3,449,086 | 6/1969 | Innes | 23/288 F |
| 3,503,715 | 3/1970 | Haensel | 23/288 FB |
| 3,649,213 | 3/1972 | De Palma | 23/288 F |
| 3,729,936 | 5/1973 | De Palma | 23/288 FB X |
| 3,755,534 | 8/1973 | Graham | 23/288 FB UX |
| 3,838,977 | 10/1974 | Warren | 23/288 F |

*Primary Examiner*—Morris O. Wolk
*Assistant Examiner*—Michael S. Marcus
*Attorney, Agent, or Firm*—Connolly and Hutz

[57] ABSTRACT

Apparatus adapted to receive one or more catalysts for the decontamination of exhaust gas of internal combustion engines. The apparatus, which includes a closed container for one or more beds of catalyst, is provided with an inlet for introducing exhaust gas thereinto and with an outlet for removing decontaminated exhaust gas therefrom. The catalyst beds are maintained in position by means of a spring-actuated clamping device which comprises a thrust rod, a mounting therefor and a spring element. The spring element, which bears against the mounting, urges the thrust rod into close contact with the catalyst beds.

5 Claims, 4 Drawing Figures

APPARATUS RECEIVING CATALYSTS FOR THE DECONTAMINATION OF EXHAUST GAS OF INTERNAL COMBUSTION ENGINES

The present invention relates to an apparatus adapted to receive one or more catalysts for the decontamination of exhaust gas of internal combustion engines, the apparatus including a closed container for one or more beds of catalyst, which closed container is provided with an inlet adapted to introduce exhaust gas thereinto and with an outlet adapted to remove decontaminated exhaust gas therefrom.

Various catalysts for the decontamination of exhaust gas of internal combustion engines have already been described, and they are commonly employed in granulated form, e.g. in the form of pelletized or moulded material.

Under the conditions, including substantial temperature changes and mechanical shocks, which normally prevail in internal combustion engines, the catalysts are subject to heavy stress. This is liable to cause serious catalyst abrasion, which may culminate in unacceptably high loss of material. It is accordingly desirable for granulated catalysts used in the decontamination of exhaust gas to be positioned in a manner which avoids catalyst-abrading flow. A further factor to consider in connection with the accommodation of the catalysts in a metal container is their coefficient of thermal expansion, which normally differs from that of the container.

In the catalytic converter described in U.S. Pat. No. 3,197,287, a granulated catalyst is accommodated in an annular chamber comprising two perforated sleeves which are arranged concentrically with respect to one another. One end of the annular chamber terminates in a seal which is rigidly connected thereto, and the other terminates in a spring-mounted annular disc. The annular chamber in turn is housed in a cylindrical casing, which is also provided with, inter alia, means permitting the introduction of exhaust gas coming from an internal combustion engine, means permitting the introduction of secondary air, and means permitting decontaminated gas to be removed therefrom. As a natural result, the springs forcing the annular disc into contact with the annular chamber are also exposed to temperatures up to 1000°C. These temperatures soon deprive the springs of their resilience, so that the springs then fail to subject the annular disc to the surface pressure which is necessary to avoid movement of the catalyst.

It is accordingly an object of the present invention to provide an apparatus adapted to receive one or more catalysts for the decontamination of exhaust gas of internal combustion engines, which enables the surface pressure necessary to avoid movement or flow of a granulated catalyst to be exerted in a reliable manner.

According to the present invention, we provide an apparatus adapted to receive one or more catalysts for the decontamination of exhaust gas of internal combustion engines, the apparatus including a closed container for one or more beds of catalyst, which closed container is provided with an inlet adapted to introduce exhaust gas thereinto and with an outlet adapted to remove decontaminated exhaust gas therefrom, the apparatus also comprising at least one clamping device actuated by means of one or more spring elements and adapted to maintain the one or more beds of catalyst in position, the spring element(s) being positioned outside the container.

Preferred features of the apparatus of the present invention, which can be used singly or in combination, provide:

a. for the (or each) clamping device to comprise a thrust rod, a mounting therefor, and a spring element, the spring element, which bears against the mounting, urging the thrust rod into close contact with the catalyst bed;

b. for the spring element to comprise a helical spring;

c. for the spring element to comprise a leaf or other non-coiled spring; and d. for the said leaf or other non-coiled spring to comprise one or more springy wires.

The spring elements, which subject the granulated catalyst to surface pressure, are positioned, as already specified, outside the container receiving the hot exhaust gas. As a result, the springs remain cold, and retain their original mechanical properties, so that the surface pressure necessary to avoid movement or flow of the catalyst is reliably exerted.

Exemplifying embodiments of the apparatus of the present invention are shown diagrammatically in longitudinal section in the accompanying drawings, wherein.

Figure 1:
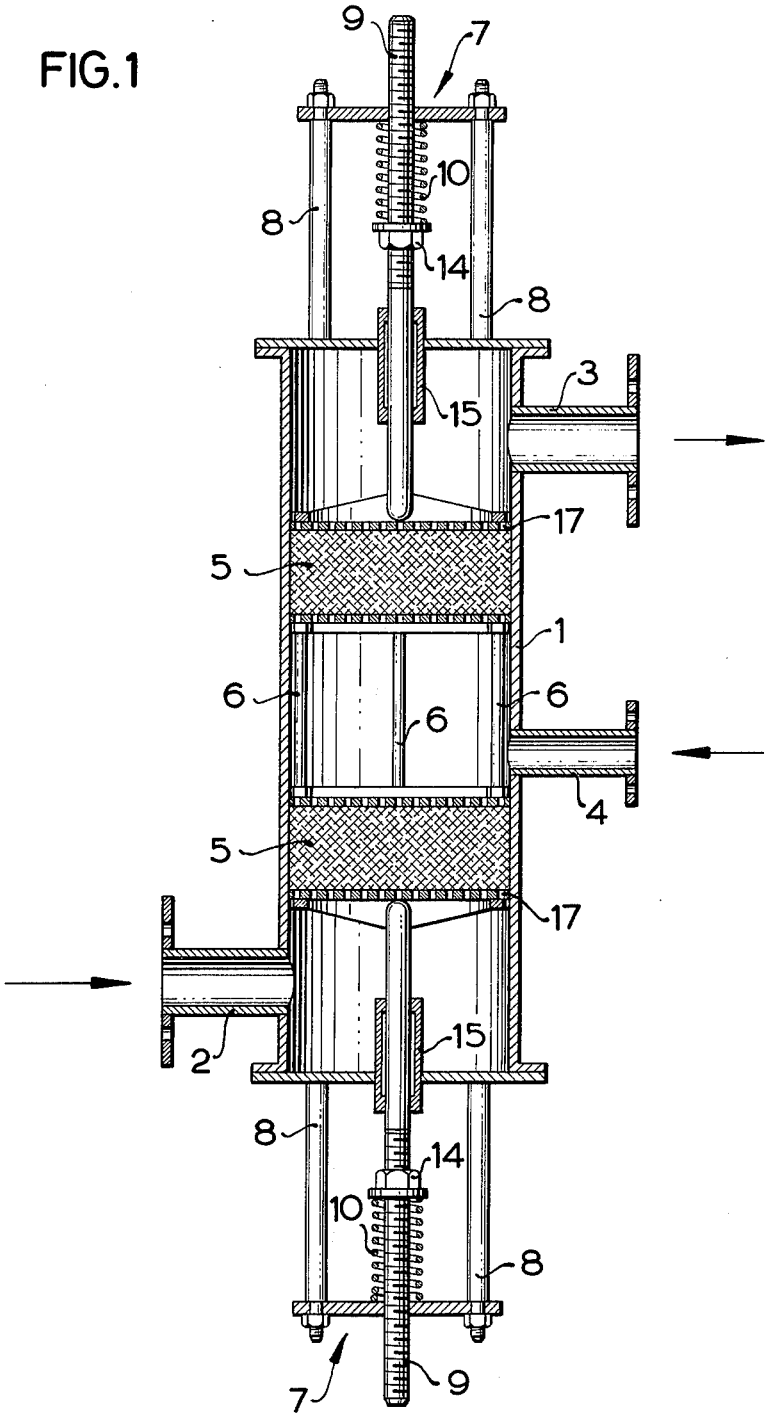
FIG. 1 shows a type of apparatus comprising two discoid beds of catalyst and two clamping devices.

As can be seen from FIGS. 1 to 4, a closed container 1 is provided with an inlet 2 adapted to introduce exhaust gas thereinto, with an outlet 3 adapted to introduce exhaust gas thereinto, with an outlet 3 adapted to remove decontaminated exhaust gas therefrom and, if desired (cf. FIG. 1), with a further inlet 4 adapted to feed secondary air thereinto. Accomodated in container 1 is (or are) one or more beds of catalyst 5 which may (as in the cases of FIGS. 1 and 2) be spaced apart from each other by means of spacers 6.

Positioned outside of the container 1 is at least one clamping device 7 (two being provided in the case of FIG. 1), comprising a thrust rod 9, a spring element (10 in FIGS. 1 to 4 and a mounting, shown in FIGS. 1-4 at 8. Disposed centrally in at least one end of the container 1 is a sleeve 15 through which is passed the thrust rod 9, which carries a nut 14 on that end which lies outside the container 1. The sleeve 15 may incorporate a labyrinth packing, for example.

In the embodiments shown in FIGS. 1 to 4, the (or each) mounting 8, which may be in the nature of a frame, and which is adapted to allow the thrust rod 9 to extend therethrough, is disposed outside the container 1, so as to encircle the thrust rod 9. Interpositioned between the (or each) mounting 8 and nut 14, and disposed around the thrust rod 9, is a helical spring 10.

Figure 2:
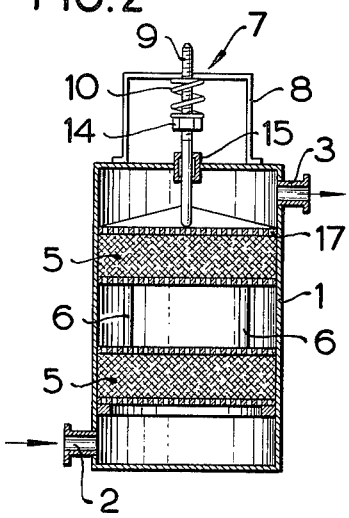
FIG. 2 shows a type of apparatus comprising two discoid beds of catalyst and one clamping device.

In the embodiments shown in FIGS. 1 and 2, use is made of springs urging the (or each) thrust rod 9 into close contact with catalyst bed 5 through pressure plates 17, which are permeable to gas.

Figure 3:
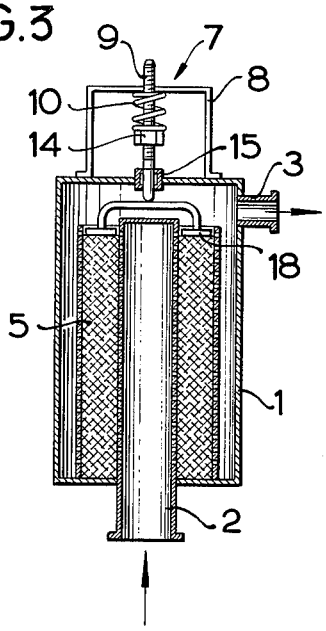
FIG. 3 shows a type of apparatus comprising a bed of catalyst, which takes the form of a hollow cylinder, and one clamping device.
Figure 4:
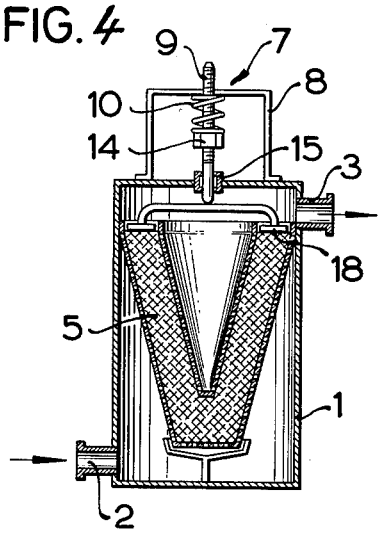
FIG. 4 shows a type of apparatus comprising a V-shaped bed of catalyst and one clamping device.

In the embodiments shown in FIGS. 3 and 4, the thrust rod 9 transmits the force of the respective springs 10 to pressure rings 18 which are impermeable to gas. In these latter embodiments, the catalyst bed 5 is bounded by walls which are also permeable to gas.

By the use of the apparatus of the present invention, surface pressures between 0.2 and 2 kg per square metre can be produced, and these are the pressures which are necessary to minimize catalyst abrasion.

We claim:

1. In an apparatus receiving catalysts for the decontamination of exhaust gas of internal combustion engines, wherein a container having a longitudinal axis and being disposed between a pair of covers is provided with an inlet for introducing exhaust gas thereinto and an outlet for removing decontaminated exhaust gas therefrom, said inlet and outlet being spaced from each other and at least one bed of particulate catalyst being confined between a pair of pressure plates permeable to gas being disposed in the space between the inlet and outlet, the improvement which comprises a clamping device being arranged outside and parallel with respect to the longitudinal axis of the container and being rigidly secured to at least one of the pair of container covers; said clamping device being an open frame-shaped mounting including two supporting beams disposed substantially parallel to said longitudinal axis and which are spaced apart and held in position by means of a cross beam; a thrust rod being extended through said cross beam and through said at least one of said pair of covers by means of a central passageway forming part of said cover; the thrust rod portion projecting outwardly through said passageway being threaded and carrying a nut positioned between said cross beam and said cover; and a helical spring concentrically surrounding said thrust rod, being clamped between said cross beam of said frame-shaped mounting and said nut and elastically urging the thrust rod into contact with at least one of the pair of pressure plates confining the bed of catalyst, whereby the bed of catalyst is maintained under compression.

2. The apparatus as claimed in claim 1, wherein the central passageway is provided with a sleeve incorporating a labyrinth packing, receiving the thrust rod and sealing the cover of the container.

3. The apparatus as claimed in claim 1, wherein the container contains two beds of catalyst being spaced apart by means of spacers and being disposed with one downstream of the other, with respect to exhaust gas travelling therethrough.

4. The apparatus as claimed in claim 3, wherein the container is penetrated in the area of the spacers by a further inlet for feeding secondary air thereinto.

5. The apparatus as claimed in claim 3, wherein a pair of clamping devices are disposed on opposite sides of the beds of catalyst.

* * * * *